United States Patent [19]

Schapink et al.

[11] Patent Number: 4,733,420

[45] Date of Patent: Mar. 29, 1988

[54] METHOD AND APPARATUS FOR IMPREGNATING A WOVEN, STRANDED OR KNITTED SLEEVE OR TUBE OF FLEXIBLE FIBRES OR THREADS

[75] Inventors: Jan Schapink, Rijssen; Frans B. Bruns, Almelo, both of Netherlands

[73] Assignee: Koninklijke Nijverdal-Ten Cate NV, Netherlands

[21] Appl. No.: 918,319

[22] Filed: Oct. 14, 1986

[30] Foreign Application Priority Data

Oct. 22, 1985 [NL] Netherlands ..... 8502880
May 15, 1986 [NL] Netherlands ..... 8601238

[51] Int. Cl.[4] ..... D06B 1/00; D06B 7/10; D06C 5/00

[52] U.S. Cl. ..... 8/151; 8/149.1; 26/80; 68/13 R

[58] Field of Search ..... 8/151, 149.1; 68/13 R, 68/175, 5 D, 22 R, 202, 205 R; 26/80, 83, 81, 84

[56] References Cited

U.S. PATENT DOCUMENTS

| | | | |
|---|---|---|---|
| 1,893,197 | 1/1933 | Cohn | 8/151 |
| 1,979,818 | 11/1934 | Baker | 8/151 X |
| 2,045,755 | 6/1936 | Cohn | 8/151 |
| 2,623,264 | 12/1952 | Dungler | 26/80 |
| 3,332,124 | 7/1967 | Beard | 26/83 X |
| 4,184,846 | 1/1980 | Diggle | 68/13 R X |
| 4,337,630 | 7/1982 | Strahm | 68/13 R |

FOREIGN PATENT DOCUMENTS

| | | |
|---|---|---|
| 3346923 | 5/1985 | Fed. Rep. of Germany . |
| 2059473 | 4/1981 | United Kingdom . |

*Primary Examiner*—Donald Watkins
*Attorney, Agent, or Firm*—John P. Snyder

[57] ABSTRACT

Method and apparatus for impregnating tubular fabrics wherein the fabric is driven over an elongate driving member extending through an impregnation station by means of a transport layer or tube extending between said fabrics and said guiding member and driven to transport the fabric through the impregnating station.

17 Claims, 9 Drawing Figures

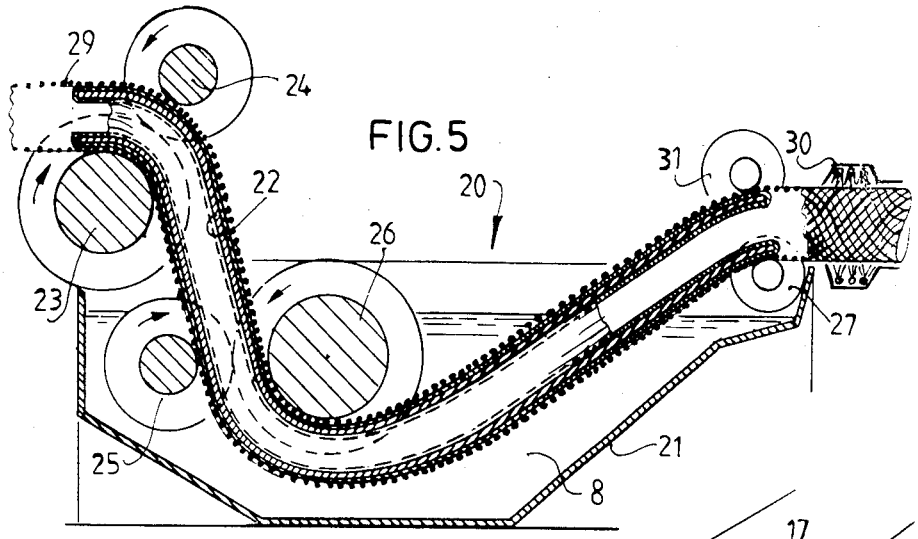
FIG.5
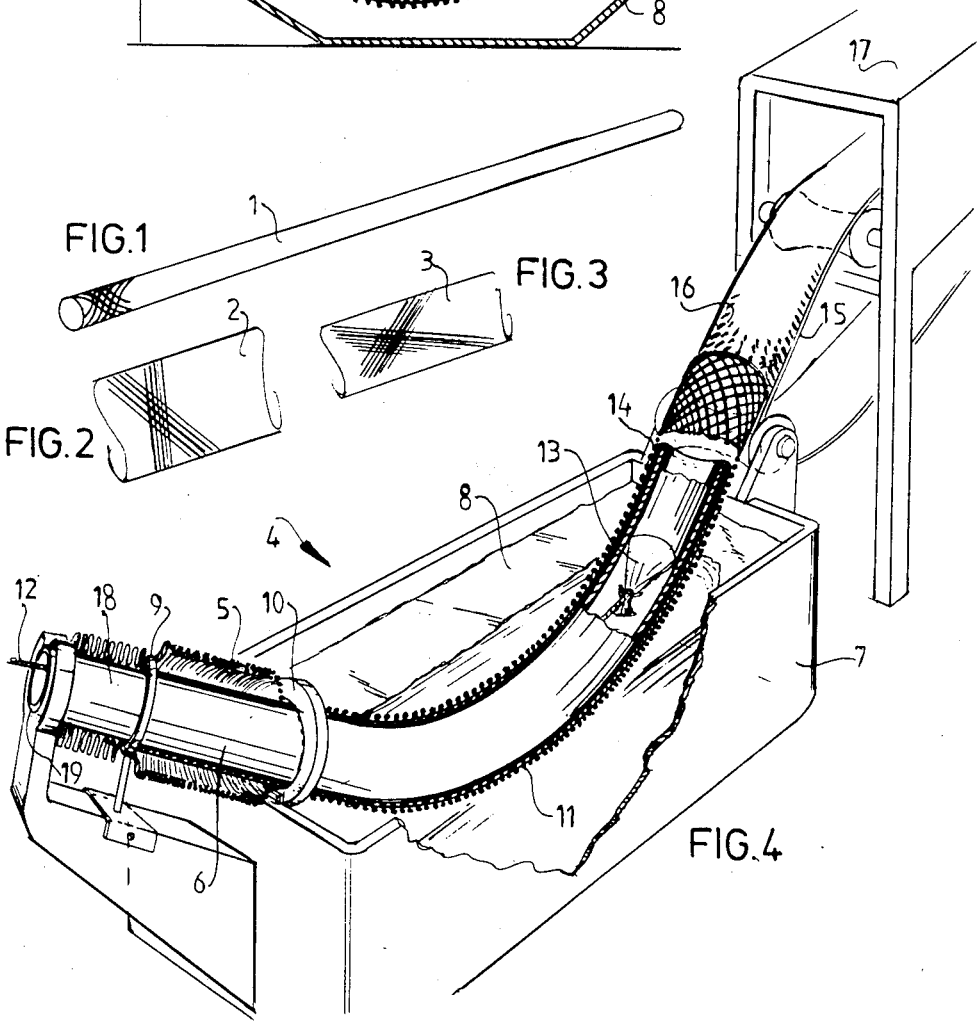
FIG.1
FIG.3
FIG.2
FIG.4

METHOD AND APPARATUS FOR IMPREGNATING A WOVEN, STRANDED OR KNITTED SLEEVE OR TUBE OF FLEXIBLE FIBRES OR THREADS

The invention relates to a method for impregnating a woven, stranded or knitted sleeve or tube of flexible fibres or threads.

Such a method is generally known. In accordance with a known method, a piece of sleeve or tube is in each case arranged manually over an oblong mandril of pre-determined diameter and by means of a brush the impregnating liquid is subsequently applied to the sleeve or tube by a member of staff.

Such a method leaves much to be desired. The homogeneity of the impregnation process can diminish after a period of time through fatigue affecting the member of staff, whereby in some places there is too much impregnating substance present and in other places there is too little or none at all. In view of the fact that the sleeve or tube is a semi-manufacture which must serve as reinforcement for tubular or bar-shaped constructions, such as tennis rackets, motor shafts, tubes for supporting frames and the like, in which the fibres serve as reinforcement to give the construction the desired bending rigidity or tensile strength, it is important that the impregnating treatment is carried out with great reliability and that moreover the orientation of the intersecting fibres satisfy the required norm within comparatively small tolerances, this with an eye to the desired mechanical properties, such as the bending rigidity and tensile strength already referred to. The manual impregnation treatment is insufficiently capable of providing a homogenous product of a uniformly high quality.

A further drawback is that some impregnants are relatively aggressive and that inhalation and contact with the skin must be avoided. From this point of view it is desirable to be able to carry out the method automatically.

As already stated, in the known method a part of a sleeve or tube to be impregnated is in each case arranged over a mandril, after which an impregnating process is performed on that part. In some circumstances it can be desired that a very long sleeve or tube to be impregnated in a continuous process. It will be apparent that the manual impregnation treatment is incapable of this.

The invention has for its object to dispense with the limitations and drawbacks of the known art and to this end provides a method of the type mentioned in the preamble, which displays the feature that the sleeve or tube to be impregnated is driven by means of driving means over an elongate guiding member extending through an impregnation station, for example a container of liquid impregnant.

Such a method according to the invention can be carried out in such a way that the sleeve or tube is driven over the guiding member by means of a transport layer or tube extending between said sleeve or tube and said guiding member and driven in longitudinal direction of said guiding member. In this way it is achieved that a positive guiding with very small friction of a sleeve or tube over the guiding member is obtained. The transport layer can for example take the form of a number of ropes, belts or threads.

Preference is given to a method according to which the guiding member is a supporting tube and that as transport layer or tube, use is made of a flexible tube or sleeve of finite length, which is pulled from the beginning of said supporting tube over said tube towards the rear end thereof, and from that rear end through said supporting tube back to the beginning thereof.

For the sake of completeness it is noted that in a discontinuous or intermittent process, after finishing an impregnation treatment of a sleeve or tube of a determined length, the transport layer or tube can be pulled back to its starting position. In a continuous or uninterrupted embodiment a sleeve or tube to be impregnated can be guided from a roll over the supporting tube by means of a transport layer or tube in an uninterrupted form.

The invention extends further to an apparatus for impregnating a woven sleeve or tube of flexible fibres or threads, said apparatus being characterized by an impregnation station, for example a container of liquid impregnant, a supporting tube with its ends projecting outside this impregnation station and extending with the part running between the said ends through the impregnation station, and a transport layer or tube drivable over at least the supporting tube.

The transport layer or tube can in particular consist of a flexible tube extending partly over the supporting tube and partly through it, whereby the end of the part of the flexible tube extending through the supporting tube is connected with a pulling element. In a simple intermittently operating apparatus the pulling element can simply take the form of a rope or cord. In a more refined, continuously operating apparatus, the pulling element can consist of the flexible tube itself which is pressed on the outside against the supporting tube by driving means, such as rollers, whereby the sleeve or tube to be impregnated is situated between the flexible transport tube and the driving means.

Also the method according to the invention may be carried out in such a way that between a sleeve or tube to be impregnated and the outer surface of the guiding member there is no transport layer or tube present. Thereto an apparatus according to the invention is characterized in that the cross-section-circumference of the guiding element is smaller than the cross-section-circumference of the sleeve or tube in its stretched condition. It will be obvious that a sleeve or tube of the present type has a certain cross-section-perimeter in the condition in which it is subjected to a longitudinal stress. The apparatus according to the invention described hereinbefore avoids clamping and jamming of the sleeve or tube on the guiding element.

In order to provide the sleeve or tube with the desired cross-section-perimeter after the impregnating treatment the apparatus may be characterized in that the guiding element exhibits at its end a broadened part, the cross-section-circumference corresponds with the desired cross-section-circumference of the impregnated sleeve or tube.

Very practical is that embodiment in which the guiding element is maintained in its position by means of rollers contacting the guiding member through the sleeve or tube. In this case advantageously use may be made of an alternative embodiment in which at least one of said rollers is driven.

As already mentioned, the relative orientation of the intersecting fibres or threads of the impregnated sleeve or tube is of the greatest importance for many applications. In this context it is recommended that after leaving the supporting tube the impregnated sleeve or tube is conveyed further such that its shape is affected as little as possible, that at least the further transport is carried out such that no compression or tensile stress occurs in the sleeve or tube. With this in mind, advantageous use can be made of a variant which displays the feature that behind the tail end of the guiding member an endless conveyor belt with pins is arranged for gripping the impregnated sleeve or tube. The fibre orientation and the diameter of the impregnated sleeve or tube can now be determined by a suitable choice of the ratio of the speed of the endless conveyor belt and that of the transport layer or tube, with which the sleeve or tube is moved round the supporting tube. For this purpose there must exist a certain free space between the end of the supporting tube and the beginning of the conveyor belt.

The invention will now be explained with reference to a drawing of several arbitrary embodiments. In the drawing FIG. 1 shows a sleeve or tube with a number of fibres, in order to show the orientation thereof;

FIG. 2 shows a part of a sleeve or tube having another fibre orientation;

FIG. 3 shows a view corresponding to FIG. 2 of a part of a sleeve or tube having another fibre orientation;

FIG. 4 shows a schematic perspective view, partly broken away, of an intermittently operating apparatus according to the invention;

FIG. 5 shows a cross section through a continuously operating apparatus according to the invention.

Figure 6:
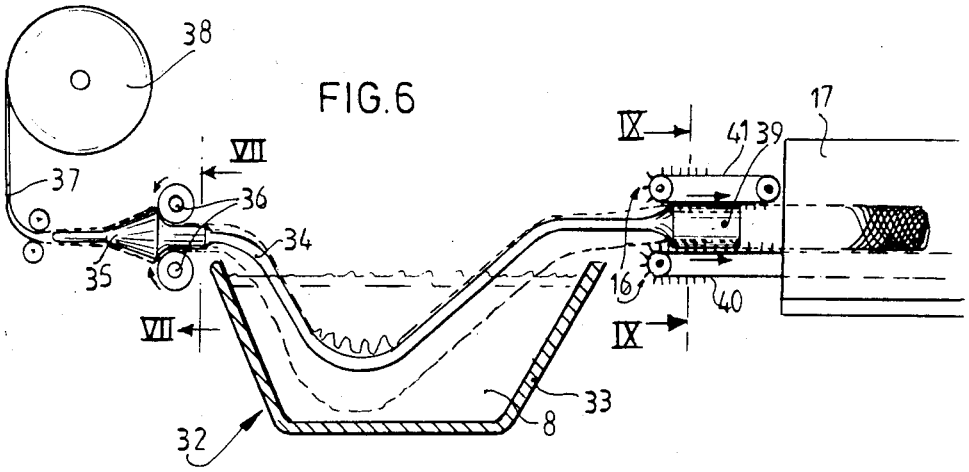
Figure 7:
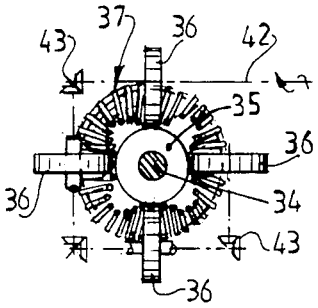
Figure 8:
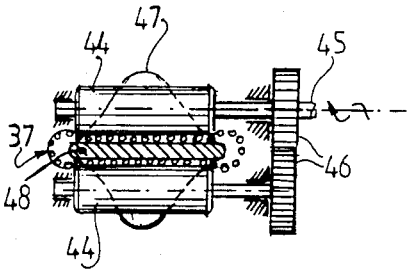
Figure 9:
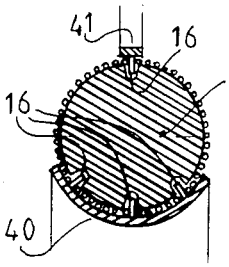

FIG. 6 a variant of the apparatus according to FIG. 5;

FIG. 7 the detail VII—VII according to FIG. 6;

FIG. 8 a alternative of the part according to FIG. 7;

FIG. 9 a cross-section IX—IX according to FIG. 6.

FIG. 1 shows an impregnated sleeve consisting of threads stranded together. The fibre orientation is indicated on the left hand side. The respective fibres intersect at angles of about 90°.

FIG. 2 shows a sleeve 2 in which the fibres form a greater angle with the longitudinal direction of the sleeve, while FIG. 3 shows a sleeve 3 in which the angle with the longitudinal direction is smaller than in the form according to FIG. 1. It will be apparent that the tensile strength will increase in proportion as the fibres lie more in the longitudinal direction.

It will be apparent that the fibre orientation is an important parameter with a view to the desired mechanical properties.

FIG. 4 shows an apparatus 4 for impregnating a woven sleeve 5. For the impregnation treatment the sleeve 5 is pushed over the initial part of a supporting tube 6 which possesses a curved form and extends through a container 7 for liquid impregnant.

Sleeve 5, which consists of a woven structure, as is shown schematically in FIGS. 1–3 inclusive, is pushed up over a short distance between a first aperture 9 extending around supporting tube 5 and a second aperture 10. Lying between supporting tube 6 and sleeve 5 is layer in the form of a flexible tube 11 which at first is pulled back for the greater part to a small axial length over the beginning zone of supporting tube 6 and in any case to before the first aperture 9. Flexible tube 11 is tied up at its end and connected with a cord 12. This cord 12 which serves as pulling element extends through the interior of supporting tube 6. The tied end 13 of flexible tube 11 can be pulled back through supporting tube 6 in this way, whereby the part of flexible tube 11 extending outside supporting tube 6 displaces to the right hand end thereof, carrying sleeve 5 with it.

Because supporting tube 6 extends through impregnation liquid 8, in this way is attained that the sleeve 5, rolled back and pulled tight and transported over and through flexible tube 11, is impregnated and can leave supporting tube 6 at the rearmost end 14. At this rear end 14 of supporting tube 6 and endless conveyor belt 15 with pins 16 is arranged for gripping and transporting the impregnated sleeve further. This manner of further transportation prevents tensile forces being applied to the impregnated sleeve, which would result in an adverse effect on the fibre orientation that has been sought after and achieved.

Conveyor belt 15 extends through a heating appliance 17 for drying the impregnant 8. After leaving heating appliance 17, the impregnated, finished sleeve can be wound round a reel for further transport.

It will be apparent that apparatus 4 can only operate discontinuously. After sleeve 5 has left the supporting tube completely, a rolled up sleeve must again be arranged between aperture 9 and aperture 10.

To this end the pulled back flexible tube 11 is rolled up again into the position shown in FIG. 4 and a new piece of sleeving of finite length to be impregnated is fitted. The foremost end 18 of supporting tube 6 is supported for this purpose by a supporting fork 19. To position a new sleeve for impregnation the end 18 is lifted out of the supporting fork, after which the rolled up sleeve can be put into position. By way of orientation it is noted that a sleeve for impregnation, which must eventually attain a length of for example 100 meters, extends only over a length of several tens of centimetres in its rolled up state.

In order to be able to start the impregnation treatment after the fitting of the sleeve, the end 18 is again put back into supporting fork 19. Cord 12 can then be pulled by undrawn means, for instance a motor with pulley, after which flexible tube 11 moves forwards over the supporting tube carrying sleeve 5 with it.

FIG. 5 shows a continuously operating apparatus 20. This comprises a receptacle containing impregnant 8 into which a supporting tube 22 extends. In contrast to the embodiment in FIG. 4, supporting tube 22 is in this case not supported by fixed points of support, but is carried solely by rollers 23, 24, 25, 26, 27, 31. The rollers are driven by an undrawn motor. Supporting tube 22 extends through impregnation liquid 8. It is encircled by a flexible tube 28, which, at variance with flexible tube 11 as in FIG. 4 is returned in entirety through the interior of supporting tube 22 and is joined to its own end, possibly via a seam, whereby an endless, i.e. closed, structure results. Flexible tube 28 can be driven by driving rollers 23 and 24. From an undrawn stock roller a sleeve 29 to be impregnated can be introduced between rollers 23 and 24 on one hand and flexible tube 28 on the other, whereby in accordance with the embodiment in FIG. 4, conveying of sleeve 29 takes place by its being carried by flexible tube 28. Rollers 25, 26, 27 are of the free rotating type. All the rollers 23–27 feature a form adopted to the circumferential shape of supporting tube 22, whereby a good, guiding support is ensured. After leaving supporting tube 22, impregnated sleeve 29 is guided through a heating appliance 30.

FIG. 6 shows an apparatus 32 provided with a liquid container 33 with liquid 8 in which a lower curved part of a guiding bar 34 extends. The guiding bar 34 is at its leading part provided with a more or less conical part 35 that exhibits at its broad downstream side a hollow shape adapted to the shape of rollers 36.

The sleeve 37 to be impregnated is unrolled from a supply reel 38, over the conical part 35, under rollers 36 along the guiding bar 34 guided in the direction of a broadened end part 39 of the guiding bar 34, where the sleeve, that is in the meantime impregnated by the liquid 8 is brought to its desired diameter.

In the area of that broadened end part 39 the sleeve 37 is further transported by a lower conveyor 40 provided with pins 16 and a similar upper conveyor 41. FIG. 9 shows in cross-section the local construction in more detail.

Rollers 36 contact at the surface of the guiding bare 34, downstream relative to the conical part 35, through the sleeve 3 to be impregnated. Due to the fact that rollers 36 are driven on the manner to be hereinafter described with reference to FIG. 7, they serve the purpose of driving with the desired speed this sleeve 37. In absence of the conical, broadened part 35 due thereto a force directed to the right would be exerted on the guiding bar 34. This force can, in this case, not cause a displacement to the right due to the presence of cone 35. Thus, this conical element 35 serve the purpose of maintaining in its position the guiding bar 34.

FIG. 7 shows the four rollers 36, in which in a symbolical fashion with reference numeral 42, the driven axis is shown, whilst perpendicular transmissions 43 serve the purpose of transferring the rotating forces to the further rollers.

FIG. 8 shows an alternative in which only two rollers 44 are used that are, by means of a driven axis, driven in opposite rotations by means of a pinion transmission 46. A broadened part 47 analogous to the conical part 35 according to FIG. 6 serves the positioning of the guiding bar 34 against displacement to the right, in correspondence with the above discussion, relative to cooperation between the container 33 with liquid 8 in which a lower curved part of a guiding bar 34 extends. The guiding bar 34 is at its leading conical part 35 and rollers 36. The downstream part 48 of the broadened part 47 is flattened in correspondence with the shape of rollers 44.

It should be noted that due the presence of the broadened input part 35 or 47 in correspondence with FIGS. 6, 7 and 8, the advantage relative to the embodiment according to FIG. 5 may be obtained that no rollers are any longer presence in the liquid 8 that might require care.

Furthermore it should be noted that in the embodiment according to FIGS. 6–9, the diameter of the guiding bar 34 has to be small enough to ensure that the sleeve 37 fits around it in its ultimate stretched condition. Thus with certainty it is avoided that the sleeve may be jammed under tension of sleeve 37.

The roller 36 can, if desired, be of the free-rotating type, in which case the conveyors 41, 42 have to bring up the total transport pulling forces. It may, however, be preferred to drive rollers 36 as well as has been described above.

In deviation of what has been described hereinbefore and shown in the drawing, the support tube or guiding bar does not necessarily have to be positioned in one vertical plane, but may be guided in a band or be bend backwardly to a starting position in order to save space.

It will go without explanation that in the contact zone of rollers 36 at the downstream part of the conical element 35 and rollers 44 at the broadened part 47 this conical element 35 and the broadened part 47, respectively, have to exhibit a surface that has a low friction coefficient common with the sleeve 37. E.g. the surface in question may be very smooth, whilst also use may be made of a coating layer of PTFE or the like. One may even think of an embodiment in which at the broadened part free rotatable rollers are present for co-operation with rollers 36, 44.

It will be apparent that the embodiments according to the figures are only examples of possible implementations of the technical principle on which the invention under consideration is based. Various alterations in the structure of the apparatus are therefore also possible.

E.g., the broadened part 49 may be omitted in deviation from what is shown in FIG. 6. The resulting cross-section-perimeter of the impregnated sleeve or tube may than be adjusted by the choice of the input speed thereof, which is determined by the rotation speed of rollers 36, and the output speed, which is determined by the speed of conveyors 40, 41, respectively.

We claim:

1. Method for impregnating a woven, stranded or knitted sleeve or tube of flexible fibers or threads, wherein the sleeve or tube to be impregnated is driven over an elongate guiding member extending through an impregnation station, for example a container of liquid impregnant, by means of a transport layer of tube extending between said sleeve or tube and said guiding member and driven in longitudinal direction of said guiding member, the guiding member being a supporting tube and that as a transport layer or tube, use is made of flexible tube or sleeve of finite length, which is pulled from the beginning of said supporting tube over said tube towards the rear end thereof, and from that rear end through said supporting tube back to the beginning thereof.

2. The method of impregnating a flexible filamentary sleeve which comprises the steps of:

providing an outer guide surface having opposite ends and an intermediate portion passing through an impregnating bath; and guiding flexible filamentary sleeve over one end of the outer guide surface progressively to pass through the impregnating bath and beyond one end of the guide surface while out of direct sliding contact with the intermediate portion of the outer guide surface, the flexible filamentary sleeve being guided over the outer guide surface without direct sliding contact therewith through the intermediary of an endless flexible sleeve.

3. The method of impregnating a flexible filamentary sleeve which comprises the steps of:

providing an outer guide surface having opposite ends and an intermediate portion passing through an impreganting bath; and guiding a flexible filamentary sleeve over one end of the outer guide surface progressively to pass through the impreganting bath and beyond one end of the guide surface while out of direct sliding contact with the intermediate portion of the outer guide surface, the flexible filamentary sleeve being guided over the outer guide surface without direct sliding contact therewith through the intermediary of a flexible sleeve of finite length.

4. Apparatus for impregnating a flexible filamentary sleeve which comprises the combination of a guide member having an intermediate portion passing through an impreganting bath and having entrance and exit ends extending respectively toward and away from the impregnating bath; means for feeding a flexible filamentary sleeve in surrounding relation to the guide member to pass through the impregnating bath and beyond the exit end of the guide member;

said guide member being a guide tube;

a flexible transport sleevle having a transporting length thereof fitted over the guide tube from the exit end thereof toward the entrance end of the guide tube and doubled over the the exit end of the guide tube to present a return length thereof which enters the interior of the guide tube;

a flexible filamentary sleeve embracing a portion of the transporting length of the transporting sleeve adjacent the entrance end of the guide tube; and said means for feeding causes the transport sleeve to slide the transport length thereof over the guide tube toward the exit end thereof to enter the guide tube at the exit end thereof and become part of the return length of the transport sleeve while the flexible filamentary sleeve passes through the impregnating bath and beyond the exit end of the guide tube without directly sliding on the guide tube.

5. Apparatus as defined in claim 4 wherein said transport sleeve is endless.

6. Apparatus as defined in claim 4 wherein said transport sleeve is of finite length presenting opposite ends thereof, said means for traveling comprising pulling mechanism for pulling the entire length of the transport sleeve through the interior of the guide tube.

7. Apparatus as defined in claim 4 including means for transporting the impregnated sleeve away from the exit end of the guide tube without substantial elongation thereof.

8. Apparatus for impregnating a flexible filamentary sleeve which comprises the combination of a guide member having an intermediate portion passing through an impregnating bath and having entrance and exit ends extending respectively toward and away from the impregnating bath; means for feeding a flexible filamentary sleeve in surrounding relation to the guide member to pass through the impregnating bath and beyond the exit end of the guide member;

said guide member being enlarged at its entrance and exit ends and said means for feeding comprising roller means at the entrance end of the guide member and conveyor means at the exit end of the guide member, the intermediate portion of the guide member being substantially smaller than the internal diameter of the flexible filamentary sleeve.

9. The method of forming an intermediate product useful as a shaped reinforcing sleeve for tubular or bar-shaped finished products, which comprises the steps of:

providing a supply of filamentary material in the form of woven, stranded or knitted flexible fibers defining a sleeve of intersecting fibers in which the orientation of the intersecting fibers imparts the desired reinforcing properties to the finished product, transporting and guiding the sleeve along a prescribed path while impregnating the sleeve with an impregnant capable of being hardened by heating while the sleeve is passing through a portion of the path and without significant sliding contact with any guiding structure and then expelling the impregnated sleeve with a desired orientation of intersecting fibers beyond such portion of the path; and heating the impregnated sleeve as expelled with the desired orientation of intersecting fibers.

10. Apparatus for forming an intermediate product useful as a shaped reinforcing sleeve for tubular or bar-shaped finished products, which comprises the combination of:

an impregnating bath containing an impregnant capable of being hardened by heating;

a supply of filamentary material in the form of woven, stranded or knitted flexible fibers defining a sleeve of intersecting fibers in which the orientation of the intersecting fibers imparts the desired reinforcing properties to the finished product, elongate guide means for receiving an end of the sleeve of intersecting fibers and causing such sleeve to follow a path passing through the impregnating bath, the guide means having an entrance end receiving the sleeve and an exit and dimensioned to expand the impregnated sleeve into shaped form;

drive means for transporting the impregnated sleeve along the path without significant sliding contact with the guide means between the entrance and exit ends thereof and for delivering the shaped impregnated sleeve beyond the exit end of the guide means with a desired orientation of intersecting fibers; and means for heating the shpaed impregnated sleeve as delivered with the desired orientation of intersecting fibers.

11. The method as defined in claim 9 wherein the sleeve is transported by a flexible tube over which it is fitted.

12. The method as defined in claim 11 wherein the flexible tube is of endless configuration and including the step of traveling the endless tube in recirculating fashion.

13. The method as defined in claim 11 wherein the flexible tube is traveled in re-entrant fashion.

14. Apparatus as defined in claim 10 wherein the elongate guide means is of small diameter between its entrance and exit ends.

15. Apparatus as defined in claim 10 wherein the guide means is in the form of a hollow tube and the drive means includes a flexible tube fitted over the hollow tube and upon which the sleeve of intersecting fibers is fitted.

16. Apparatus as defined in claim 15 wherein the flexible tube is also projected into the hollow tube.

17. Apparatus as defined in claim 16 wherein the flexible tube is of endless form.

* * * * *